US009228803B2

(12) United States Patent
Edge et al.

(10) Patent No.: US 9,228,803 B2
(45) Date of Patent: Jan. 5, 2016

(54) UNIVERSAL TUBE LAUNCHED MUNITIONS SYSTEM

(71) Applicants: Richard Edge, Hermitage, PA (US); Brian Vuksanovich, Poland, OH (US); Patrick Mancini, Johnstown, PA (US)

(72) Inventors: Richard Edge, Hermitage, PA (US); Brian Vuksanovich, Poland, OH (US); Patrick Mancini, Johnstown, PA (US)

(73) Assignee: CSI-PENN ARMS, LLC, Jamestown, PA (US)

( * ) Notice: Subject to any disclaimer, the term of this patent is extended or adjusted under 35 U.S.C. 154(b) by 174 days.

(21) Appl. No.: 13/897,750

(22) Filed: May 20, 2013

(65) Prior Publication Data

US 2015/0354920 A1 Dec. 10, 2015

(51) Int. Cl.

| | |
|---|---|
| ***F41F 3/042*** | (2006.01) |
| ***F41F 5/00*** | (2006.01) |
| ***F41F 1/06*** | (2006.01) |

(52) U.S. Cl.

CPC . *F41F 3/042* (2013.01); *F41F 1/06* (2013.01); *F41F 5/00* (2013.01)

(58) Field of Classification Search

CPC ..... F41F 1/06; F41F 1/08; F41F 3/04; F41F 3/042; F41F 3/052; F41F 3/06; F41F 3/065; F41F 5/00; F41F 5/04

See application file for complete search history.

(56) References Cited

U.S. PATENT DOCUMENTS

| | | | | |
|---|---|---|---|---|
| 3,598,015 | A * | 8/1971 | Delistovich et al. | 89/1.814 |
| 3,708,563 | A * | 1/1973 | Sells | 264/46.5 |
| 3,753,382 | A * | 8/1973 | Rusbach | 89/1.815 |
| 3,808,940 | A * | 5/1974 | Schillreff et al. | 89/1.1 |
| 5,157,222 | A * | 10/1992 | La Mura et al. | 102/355 |
| 5,554,815 | A * | 9/1996 | Authie et al. | 89/1.59 |
| 2007/0214948 | A1* | 9/2007 | Centrone | 86/20.1 |
| 2010/0089226 | A1* | 4/2010 | Jones et al. | 89/1.1 |
| 2010/0243799 | A1* | 9/2010 | Al-Qaffas | 244/110 C |
| 2014/0208927 | A1* | 7/2014 | Cox et al. | 89/1.51 |

* cited by examiner

*Primary Examiner* — Bret Hayes

(74) *Attorney, Agent, or Firm* — Bennett K. Langlotz; Langlotz Patent & Trademark Works, Inc.

(57) ABSTRACT

A universal tube launched munitions system has a launcher base having an array of a plurality of initiator stations, first and second cassettes each having a mounting facility operable for releasable connection to the launcher base, each of the cassettes having a plurality of barrels, the barrels of the first cassette been axially registered with the first quantity of the initiator stations, and the barrels of the second cassette been axially registered with a different second quantity of the initiator stations. The barrels of the first cassette may be axially registered with all of the initiator stations. The barrels of the second cassette may be axially registered with a subset of the initiator stations the barrels of the first cassette are axially registered with. The barrels of the first cassette may have a different diameter than the barrels of the second cassette.

25 Claims, 9 Drawing Sheets

UNIVERSAL TUBE LAUNCHED MUNITIONS SYSTEM

FIELD OF THE INVENTION

The present invention relates to munitions launchers, and more particularly to a munitions launcher that can launch munitions of multiple types in multiple calibers.

BACKGROUND OF THE INVENTION

A number of designs of electronically fired explosive-propulsion projectile weapons and non-explosive projectile weapons have been developed that have some similarities to 18th-century volley guns, particularly in that they use many barrels which can be fired all at once or in sequence. Various forms of the weapon have been designed, including aircraft-mounted guns firing downward, man-portable artillery packs and defensive applications, such as ship-based anti-missile defense systems.

Although these designs are effective for their intended purpose, they are limited to the use of a specific munitions manufactured in a specific caliber, which is typically intended to be lethal. Given the current mandate to lessen civilian casualties in military operations, prepare for the enemy's use of non-combatants as protective shields, and protect in-the-ater buildings during urban conflicts, military forces need a combination of both non-lethal and lethal munitions. Vessels need to be able to determine the intent of oncoming watercraft without causing casualties and respond when hostile intent is determined. Similarly, ground forces need to be able to separate combatants from non-combatants, escalate force as necessary, and enhance force protection while operating vehicle check points and entry control points, and during convoy security operations.

Conventional approaches to addressing this problem of intent determination require separate launch platforms for each type of munitions (non-lethal and lethal in various calibers). This creates challenges with providing training, supplies, and space for multiple launch platforms that each use different munitions.

Therefore, a need exists for a new and improved universal tube launched munitions system that uses a variety of non-lethal and lethal munitions in multiple calibers. In this regard, the various embodiments of the present invention substantially fulfill at least some of these needs. In this respect, the universal tube launched munitions system according to the present invention substantially departs from the conventional concepts and designs of the prior art, and in doing so provides an apparatus primarily developed for the purpose of providing a single munitions launcher that can launch a variety of munitions in multiple calibers.

SUMMARY OF THE INVENTION

The present invention provides an improved universal tube launched munitions system, and overcomes the above-mentioned disadvantages and drawbacks of the prior art. As such, the general purpose of the present invention, which will be described subsequently in greater detail, is to provide an improved universal tube launched munitions system that has all the advantages of the prior art mentioned above.

To attain this, the preferred embodiment of the present invention essentially comprises a launcher base having an array of a plurality of initiator stations, first and second cassettes each having a mounting facility operable for releasable connection to the launcher base, each of the cassettes having a plurality of barrels, the barrels of the first cassette been axially registered with the first quantity of the initiator stations, and the barrels of the second cassette been axially registered with a different second quantity of the initiator stations. The barrels of the first cassette may be axially registered with all of the initiator stations. The barrels of the second cassette may be axially registered with a subset of the initiator stations the barrels of the first cassette are axially registered with. The barrels of the first cassette may have a different diameter than the barrels of the second cassette. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1A:
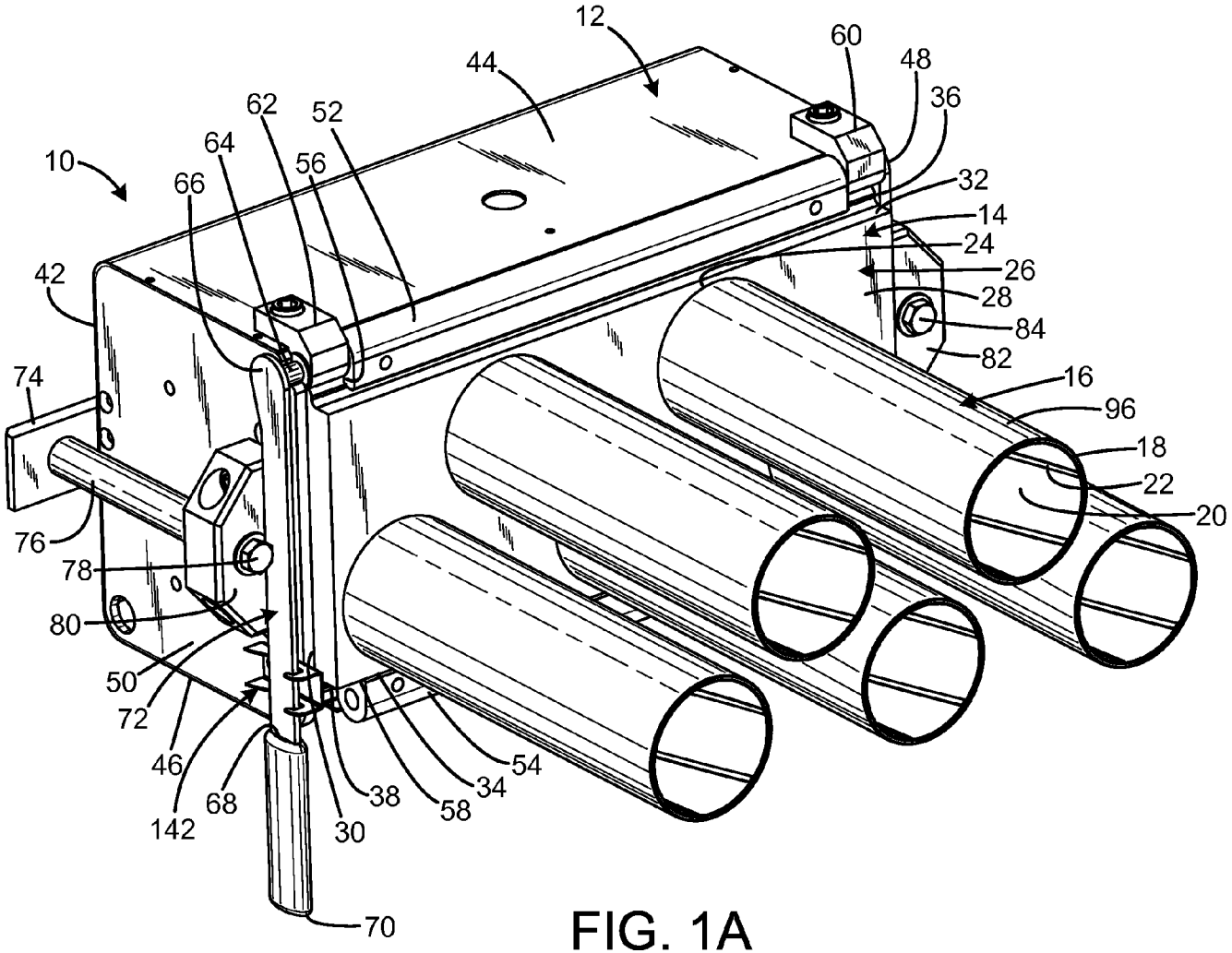
FIG. 1A is a top isometric view of the current embodiment of a universal tube launched munitions system loaded with a 66 mm cassette constructed in accordance with the principles of the present invention.

An embodiment of the universal tube launched munitions system of the present invention is shown and generally designated by the reference numeral 10.

Figure 1B:
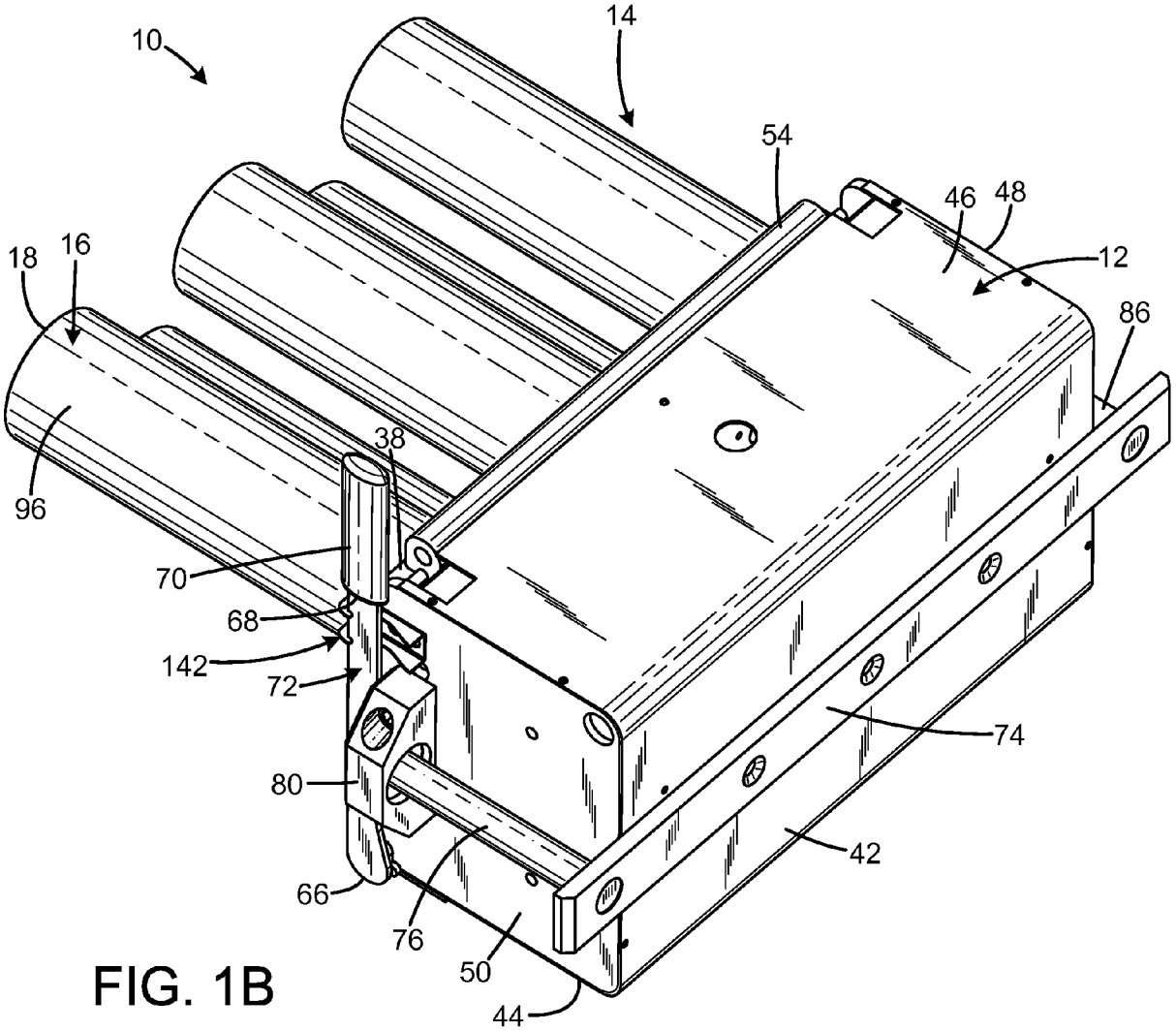
FIG. 1B is a bottom isometric view of the universal tube launched munitions system loaded with a 66 mm cassette of the present invention.

FIGS. 1A and 1B illustrate the improved universal tube launched munitions system 10 of the present invention. More particularly, the munitions system is shown with a five barrel 66 mm round launcher cassette 14 removably attached to a base plate 12.

The cassette 14 has five barrels 16 with a muzzle 18, an interior bore 20, an exterior 96, and a bottom 24. The bore is depicted with rifling 22, but the bore can also be smooth in alternative embodiments. The bottom of each tube/barrel is attached perpendicularly to the front surface 28 of a cassette plate 26. In the current embodiment, the barrels are inserted from behind into counterbores so they go through the cassette plate. The top edge 32 and bottom edge 34 of the cassette plate form a top flange 36 and a bottom flange 38 to releasably attach the rear surface 30 of the cassette plate to the front surface 40 of the base plate 12. For the 66 mm embodiment, each barrel has an outer diameter of 2.849 inches, an inner diameter of 2.665 inches, and a center-to-center diagonal spacing of 3.536 inches. The barrel grid spacing is 2.5 inches× 2.5 inches.

The launcher base plate 12 has a front side 40, rear side 42, top 44, bottom 46, right side 48, and left side 50. The top, bottom, and/or sides may have apertures to permit cables to enter the base plate. A left ear 80 is attached to the front of the left side. A right ear 82 is attached to the front of the right side. Opposing ends of the mounting bracket 74 are connected to the ears by a left bolt 78 and a right bolt 84 that are threadedly connected to a left support 76 and a right support 86. The mounting bracket may have apertures to enable the munitions system 10 to be attached to a variety of tactical vehicles, robots, and vessels.

The cassette 14 is releasably attached to the base plate 12 by a top jaw 52 and a bottom jaw 54. The bottom jaw 54 has an upward facing channel 58 that receives the bottom flange 38 of the cassette. The top jaw 52 has a downward facing channel 56 that receives the top flange 36 of the cassette. The bottom jaw is fixed in position, whereas the top jaw is pivotally mounted on a hinge pin 64 suspended between a left hinge 62 and a right hinge 60. In the current embodiment, pin 64 is actually two pins, one on each side to interface with hinges 60 and 62, to facilitate manufacturing. The rear 66 of a handle 72 is attached to the left end of the hinge pin. A grip 70 is attached to the front 68 of the handle. The handle is depicted in its locked position, which secures the rear surface 30 of the cassette plate 26 against the front surface 40 of the base plate (visible in FIGS. 2, 3, 5, and 6). A small tang 142 snaps over the handle to hold the handle in its locked position. In the current embodiment, the handle is made of ⅛ inch thick bar steel, which is both durable and flexible. This thickness of material gives the handle sufficient flexibility to be pushed to the side to disengage the tang 142 to enable the handle to rotate and unlock the cassette.

Figure 2:
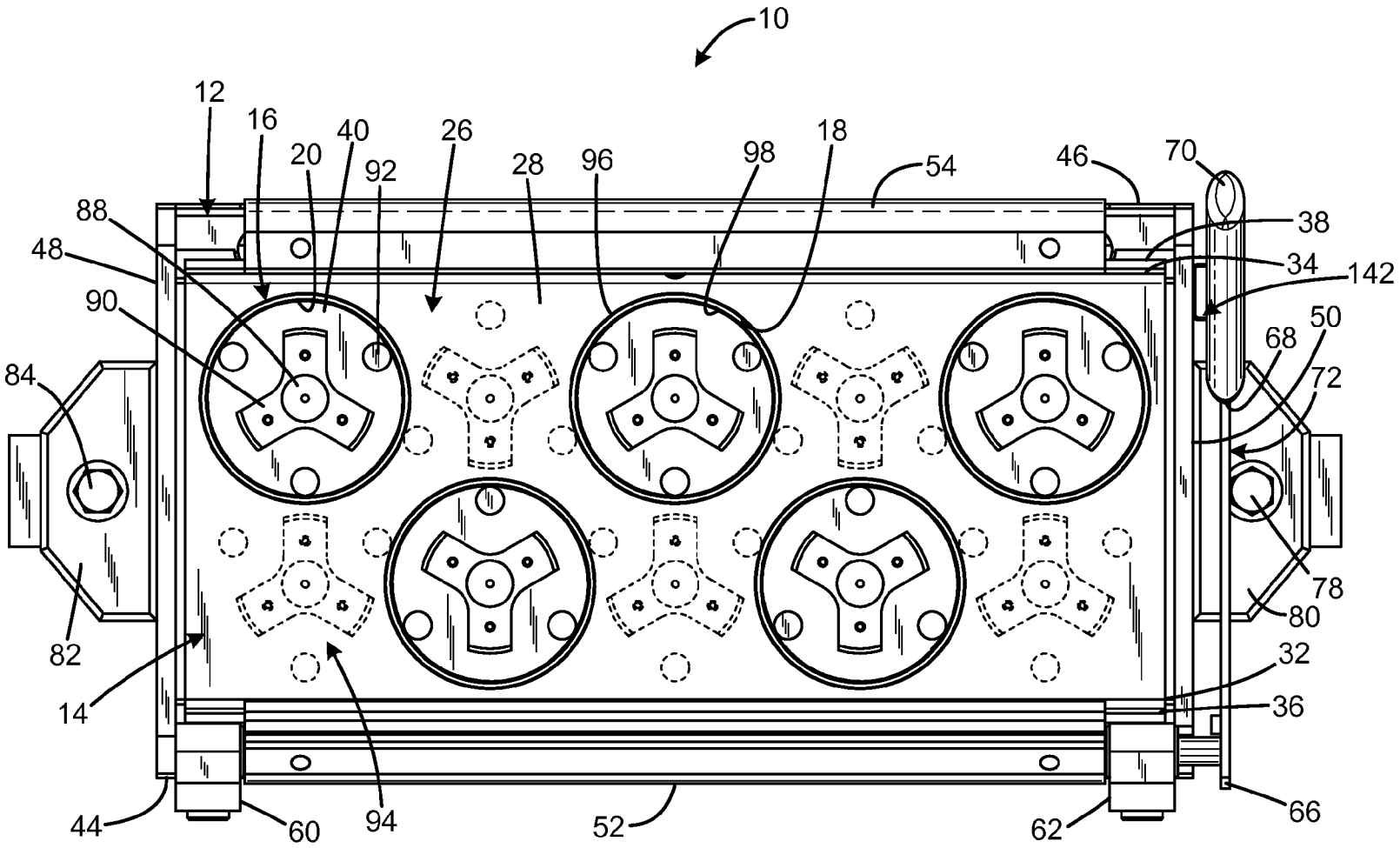
FIG. 2 is a front view of the universal tube launched munitions system loaded with a 66 mm cassette of the present invention.

FIG. 2 illustrates an embodiment of the improved universal tube launched munitions system 10 of the present invention. More particularly, each of the barrels 16 is axially registered with a cassette plate aperture 98 in the cassette plate 26. The five barrels 16 are arranged in a diagonal two-tiered grid on the cassette plate 26 so that each barrel is axially registered with one of the ten initiator stations 94 that are arranged in an orthogonal rectangular 2×5 grid on the front surface 40 of the base plate 12.

Each of the initiator stations 94 has a triangular standoff 90 with a central initiator aperture 88. Three circular standoffs 92 are positioned about the central initiator aperture in a reciprocal triangular arrangement. The circular standoffs are spaced such that the three circular standoffs associated with an initiator station that is aligned with a barrel 16 contact the interior 20 of the barrel. These points of contact prevent lateral movement of the cassette 14, ensure each barrel is axially registered with the barrel's initiator station when the cassette is locked into position against the front surface 40 of the base plate 12, and support the 66 mm rounds by seating the munitions against the counterbores in the base plate.

Figure 3:
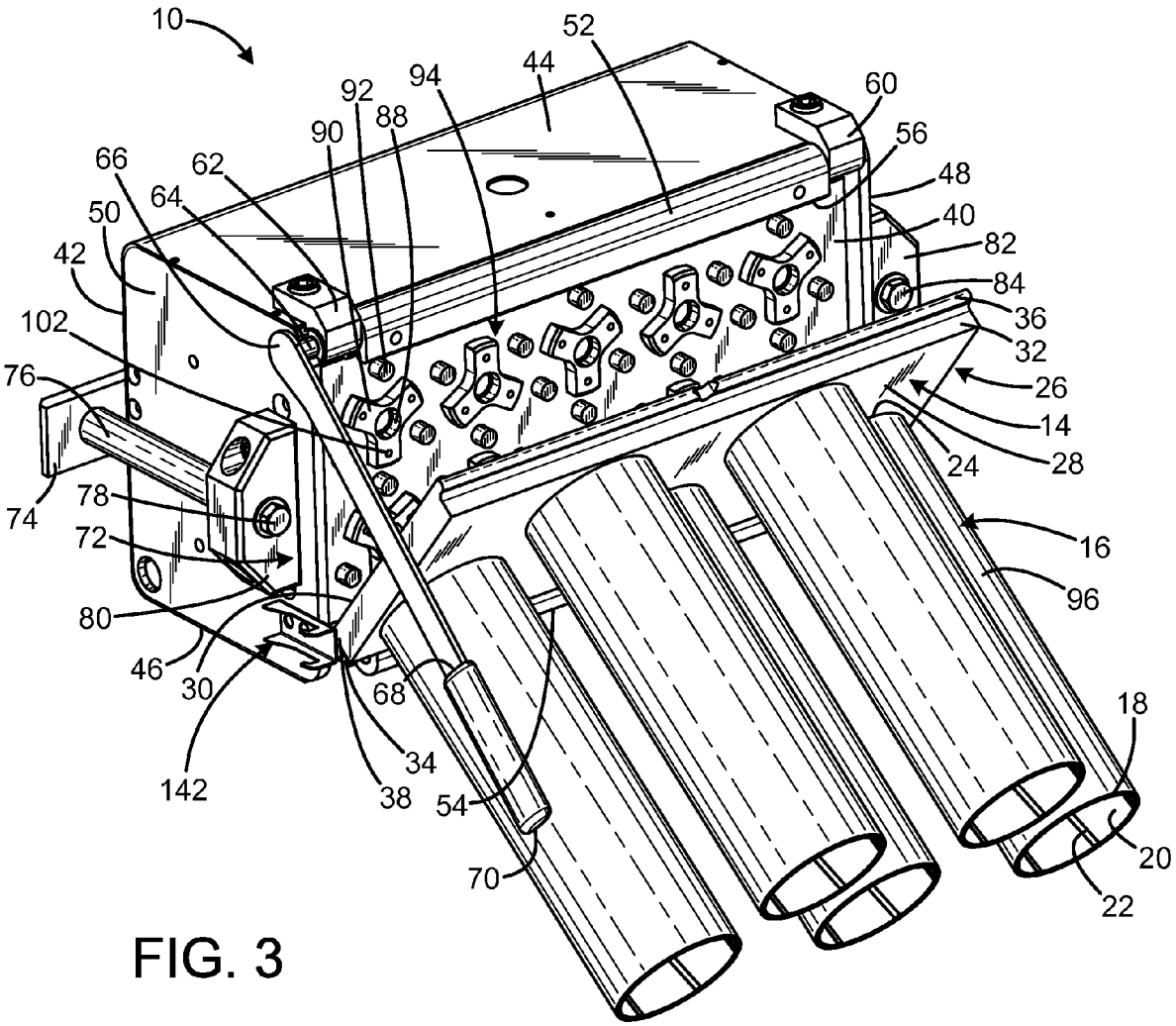
FIG. 3 is a top isometric view of the universal tube launched munitions system of the present invention with a partially dismounted 66 mm cassette.

FIG. 3 illustrates the improved universal tube launched munitions system 10 of the present invention. More particularly, the cassette 14 is shown partially dismounted. The bottom flange 38 of the cassette plate 26 is inserted into the channel 58 in the bottom jaw 54. The handle 72 has been unlocked and rotated in a counterclockwise direction from its locked position to raise the channel 56 in the top jaw 52. In order to finish loading the cassette, the top edge 32 of the cassette plate is pivoted downward about the bottom jaw until the top flange 36 is received by the channel 56 in the top jaw. The handle is then rotated in a clockwise direction to pull the rear surface 30 of the cassette plate 26 downward against the front surface 40 of the base plate 12. The circular standoffs 92 of the base plate and the recessed nature of the front surface of the cassette serve to axially register each barrel with the barrel's initiator station 94.

Figure 4A:
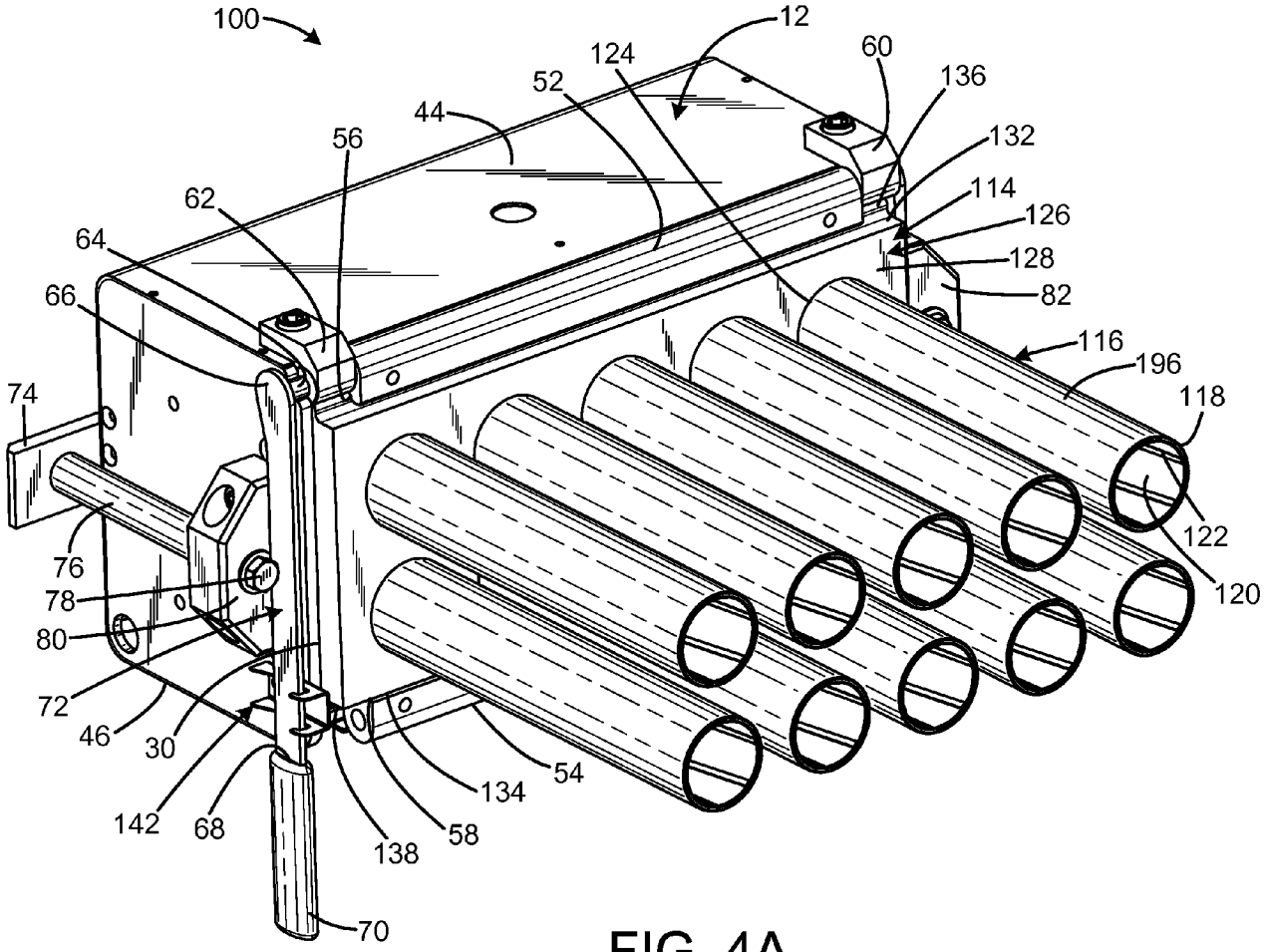
FIG. 4A is a top isometric view of the current embodiment of a universal tube launched munitions system loaded with a 40 mm cassette constructed in accordance with the principles of the present invention.
Figure 4B:
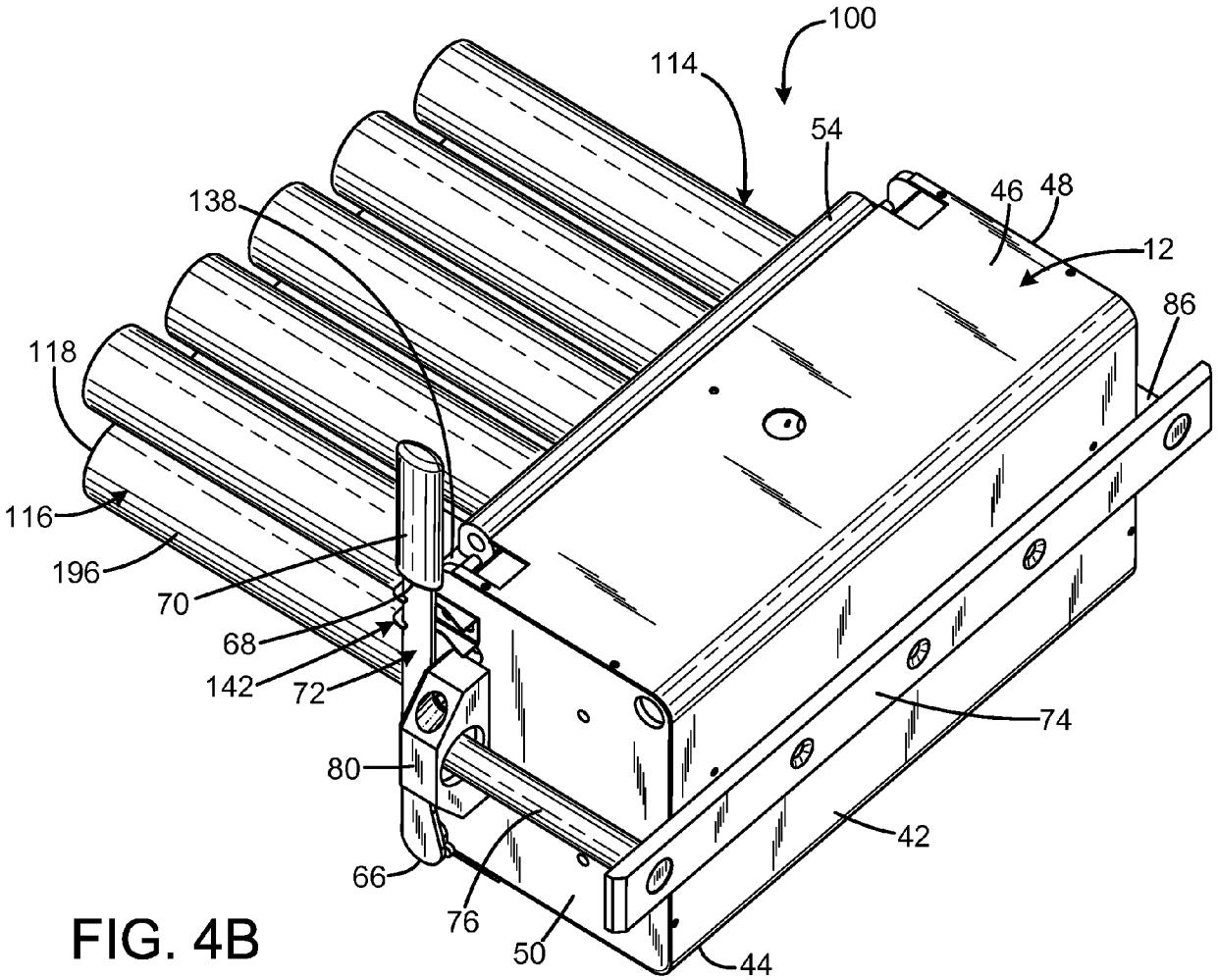
FIG. 4B is a bottom isometric view of the universal tube launched munitions system loaded with a 40 mm cassette of the present invention.

FIGS. 4A and 4B illustrate the improved universal tube launched munitions system 100 of the present invention. More particularly, the munitions system is shown with a ten barrel 40 mm round launcher cassette 114 removably attached to the base plate 12. The universal tube launched munitions system 100 is identical to the universal tube launched munitions system 10 except for specific characteristics of the cassette 114. This enables a 66 mm cassette 14 and a 40 mm cassette 114 to both be used interchangeably with the same base plate 12 without any modifications of the base plate.

The cassette 112 has ten barrels 116 with a muzzle 118, an interior bore 120, an exterior 196, and a bottom 124. The bore is depicted with rifling 122, but the bore can also be smooth in alternative embodiments. The bottom of each tube is attached perpendicularly to the front surface 128 of a cassette plate 126. In the current embodiment, the barrels are inserted from behind into counterbores so they go through the cassette plate. The top edge 132 and bottom edge 134 of the cassette plate form a top flange 136 and a bottom flange 138 to releasably attach the rear surface 130 of the cassette plate to the front surface 40 of the base plate 12. For the 40 mm embodiment, each barrel has an outer diameter of 1.825 inches, an inner diameter of 1.641 inches, and a center-to-center diagonal spacing of 3.536 inches. The barrel grid spacing is 2.5 inches×2.5 inches.

The cassette 114 is releasably attached to the base plate 12 by a top jaw 52 and a bottom jaw 54. The bottom jaw 54 has an upward facing channel 58 that receives the bottom flange 138 of the cassette. The top jaw 52 has a downward facing channel 56 that receives the top flange 136 of the cassette. The handle is depicted in its locked position, which secures the rear surface 130 of the cassette plate 126 against the front surface 40 of the base plate. In the current embodiment, the locked position is over-center, making the mechanism self-locking like locking pliers. The operator receives tactile feedback from the locking action to know that the handle is locked.

Figure 5:
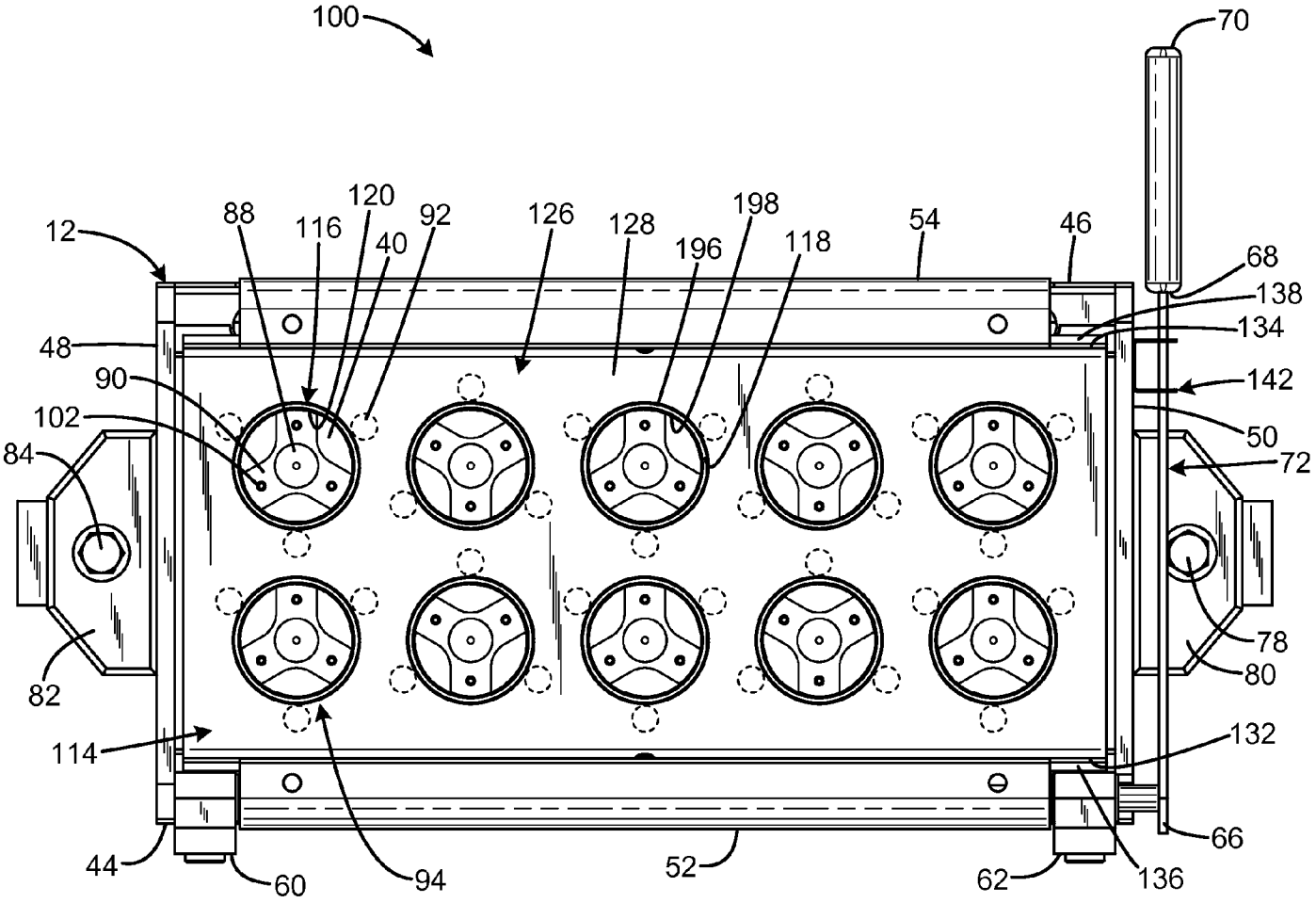
FIG. 5 is a front view of the universal tube launched munitions system loaded with a 40 mm cassette of the present invention.

FIG. 5 illustrates the improved universal tube launched munitions system 100 of the present invention. More particularly, each of the barrels 116 is axially registered with a cassette plate aperture 198 in the cassette plate 126. The ten barrels 116 are arranged in an orthogonal rectangular 2×5 grid on the cassette plate 126 so that each barrel is axially registered with one of the ten initiator stations 94 that are arranged in an orthogonal rectangular 2×5 grid on the front surface 40 of the base plate 12. The 40 mm barrels have a substantially smaller diameter than the 66 mm barrels of the cassette 14, which permits the 40 mm barrels to be arranged orthogonally instead of diagonally. This arrangement also permits the number of barrels to be doubled.

Each of the initiator stations 94 has a triangular standoff 90 with a central initiator aperture 88 and three ground apertures 102. Three circular standoffs 92 are positioned in a reciprocal triangular arrangement. The circular standoffs are spaced such that the three circular standoffs associated with an initiator station that is aligned with a barrel 116 do not contact the exterior 196 of the barrel. The interior of the bore in the cassette 114 contacts the rounded protrusions of the triangular standoff 90 associated with the barrel's initiator station. These points of contact prevent lateral movement of the cassette 114, ensure each barrel is axially registered with the barrel's initiator station when the cassette is locked into position against the front surface 40 of the base plate 12, and support the 40 mm rounds by seating the munitions against the counterbores in the base plate.

Figure 6:
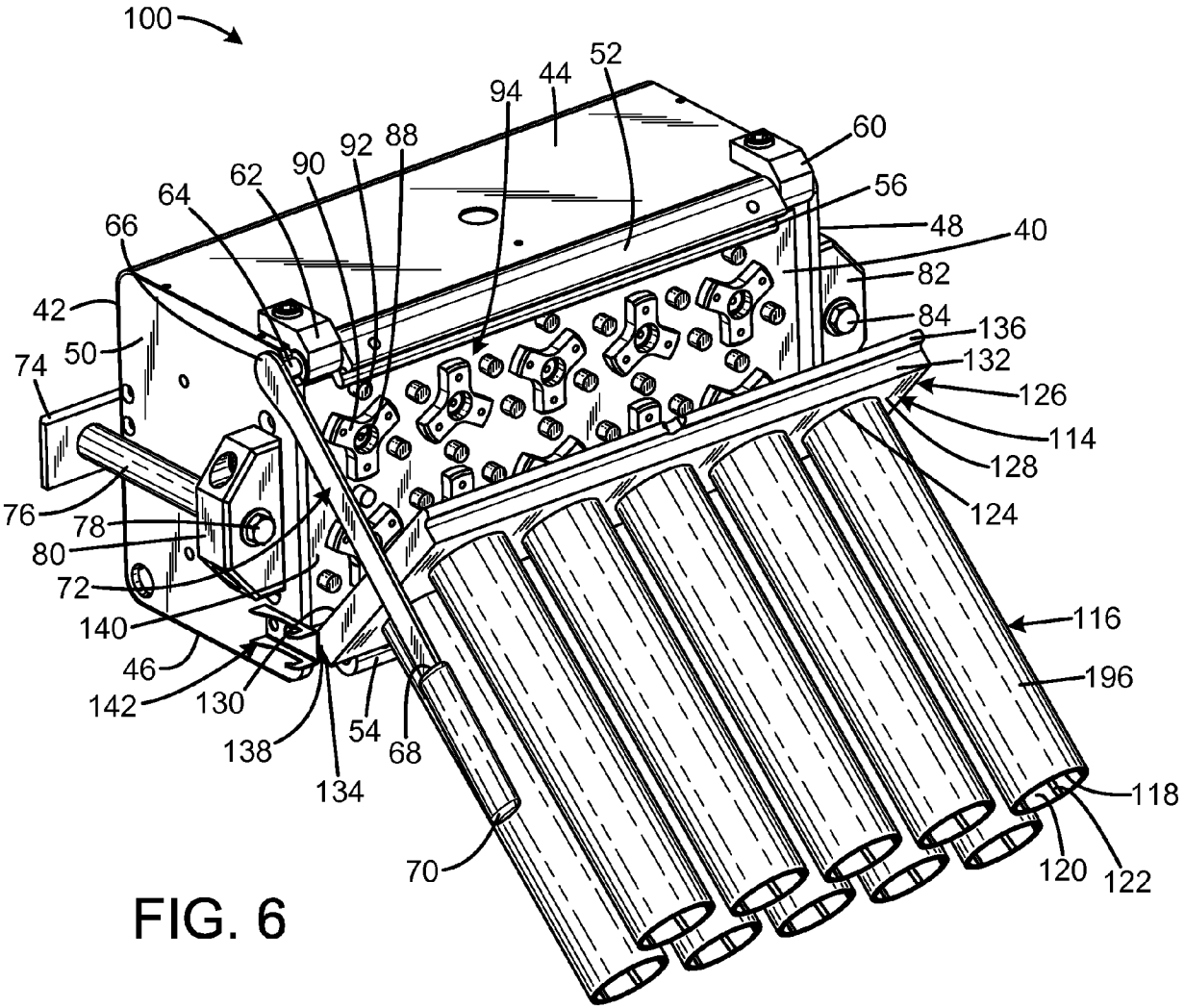
FIG. 6 is a top isometric view of the universal tube launched munitions system of the present invention with a partially dismounted 40 mm cassette.

FIG. 6 illustrates the improved universal tube launched munitions system 100 of the present invention. More particularly, the cassette 114 is shown partially dismounted. The bottom flange 138 of the cassette plate 126 is inserted into the channel 58 in the bottom jaw 54. The handle 72 has been unlocked and rotated in a counterclockwise direction from its locked position to raise the channel 56 in the top jaw 52. In order to finish loading the cassette, the top edge 132 of the cassette plate is pivoted downward about the bottom jaw until the top flange 136 is received by the channel 56 in the top jaw. The handle is then rotated in a clockwise direction to pull the rear surface 130 of the cassette plate 126 downward against the front surface 140 of the base plate 12. The triangular standoffs 90, circular standoffs 92, and the recessed nature of the front surface of the base plate serve to axially register each barrel with the barrel's initiator station 94.

Figure 7:
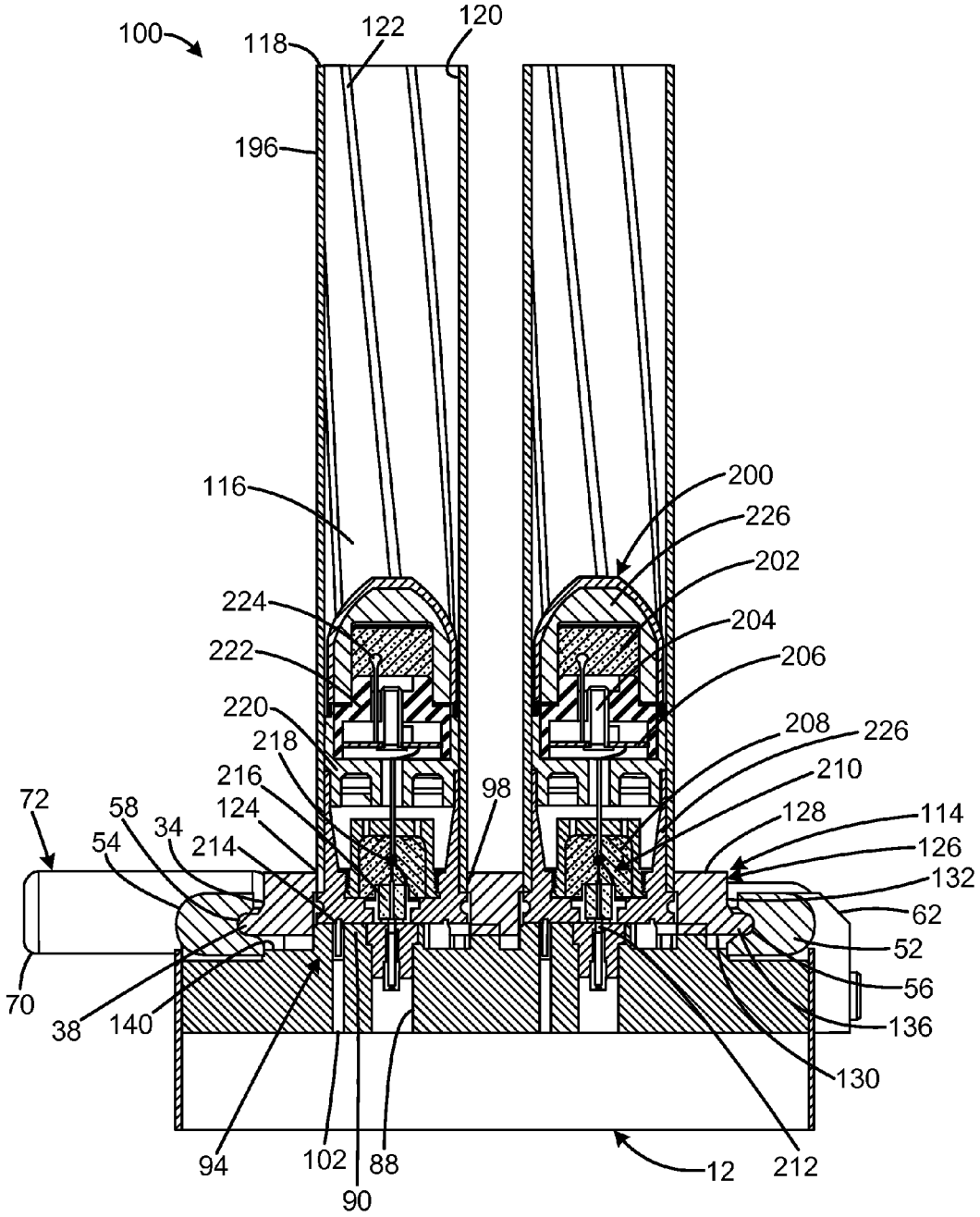
FIG. 7 is a side sectional view of the universal tube launched munitions system loaded with a 40 mm cassette of the present invention.

FIG. 7 illustrates the improved universal tube launched munitions system 100 of the present invention. More particularly, each barrel 116 contains up to seven projectiles 200. The projectiles may include:

CS or colored smoke.

Combination cartridges containing 5 smoke and 1 flash bang or impact cartridges that dispense a variety of projectiles such as rubber balls and foam batons.

4 flash bangs that are projected simultaneously and detonate at a range of 125 meters.

Single flash bang with an extended range of up to 500 meters.

The loaded rounds are hermetically sealed and waterproofed to protect the ammunition from harsh environmental hazards. Flash bang rounds can reach extended ranges of up to 500 meters and multi-bang rounds can be set for varying distances in one contained unit.

In the current embodiment, each barrel 116 is loaded with a projectile 200 that is a 40 mm flash bang grenade with a programmable range. The projectile has an ogive 226 that is connected to a driving band body 220. The ogive covers a payload charge cup 202 and an adapter housing 222. The payload charge cup receives a payload (not shown) and contains an electric match 224 as a payload initiator. The adapter housing is made of rubber in the current embodiment and has a pyrotechnical delay 204 that is in communication with the payload charge cup and serves as a backup source of payload ignition in the event the electric match 224 fails to ignite. The adapter housing also receives a circuit board 206 that processes all electronic commands, including initiation of both initiators.

The driving band body 220 is attached to a cartridge body. The cartridge body receives a propulsion cup 208 that receives a propulsion compound (not shown) to propel the projectile 200 out of the barrel. The propulsion cup contains an electric match 218 that serves as a propulsion initiator.

The initiator apertures 88 and ground apertures 102 in the triangular standoff 90 receive a communication conductor 212 and ground conductors 214, respectively. The cartridge body 226 contains a glass insulator 216 that surrounds all but the tip 228 of the communication conductor to prevent inadvertent contact of the communication conductor with the cartridge body. Communications wires 210 connect the communication conductor and the cartridge body to the circuit board 206. The circuit board 206 is also connected to the pyro-technical delay 204 and both electric matches 224 and 218.

Communication signal travels from a launch controller (not shown) to the circuit board 206 via the communication conductor 212. The circuit board has an EEPROM (Electrically Erasable Programmable Read-Only Memory) that provides information to the launch controller that can include the information about the projectile 200 such as the muzzle velocity and lot number. The ground path through the cartridge body via the ground conductors 214 provides a ground potential for which commands can be sent and received to a smart round and also provides a continuity check to establish a projectile is loaded in the barrel 116 to establish round presence for "dumb" munitions. When the launch controller is given the instruction to fire the projectile, the launch controller communicates a range to the circuit board and sends an electrical signal that ignites the propulsion electric match 218, which in turn ignites the propulsion compound to launch the projectile. The launch pressure ignites the pyrotechnical delay 204. The circuit board references a ballistic table stored on the circuit board to determine the delay time for the desired range, counts down from the countdown time, and then initiates the payload by igniting the electric match 224. In the event the circuit board or electric match 224 fails, the pyrotechnical delay initiates the payload after a preset time.

While current embodiments of a universal tube launched munitions system have been described in detail, it should be apparent that modifications and variations thereto are possible, all of which fall within the true spirit and scope of the invention. For example, although "smart munitions" with a circuit board that can be programmed with a countdown time immediately prior to launch have been described, the ignition system can also be used with "dumb munitions" that have preset detonation times. In addition, the cassettes themselves can have communication capabilities to function as adapters for legacy "smart" ammunition. Furthermore, although cassettes with all of the barrels having a single caliber have been described, a cassette could have barrels of more than one caliber with the appropriate spacing arrangement. This would enable the type of round being fired to be altered without accessing the device directly to change the cassette, thereby facilitating escalation during a firefight without exposing personnel to enemy fire.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tube launched munitions system comprising:

a launcher base having an array of a plurality initiator stations;

a first cassette having a mounting facility operable for releasable connection to the launcher base;

a second cassette having a mounting facility operable for releasable connection to the launcher base;

each of the cassettes having a plurality of barrels;

the barrels of the first cassette being axially registered with a first quantity of the initiator stations when the first cassette is positioned on the base individually;

the barrels of the second cassette being axially registered with a different second quantity of the initiator stations when the second cassette is positioned on the base individually; and wherein a center to center spacing from at least one initiator station to an adjacent initiator station is a distance smaller than a caliber of each of the barrels of the second cassette.

2. The system of claim 1 wherein the barrels of the first cassette are axially registered with all of the initiator stations.

3. The system of claim 2 wherein the barrels of the second cassette are axially registered with half of the initiator stations.

4. The system of claim 1 wherein the barrels of the second cassette are axially registered with a subset of the initiator stations the barrels of the first cassette are axially registered with.

5. The system of claim 1 wherein each of the barrels of the first cassette have a different diameter than each of the barrels of the second cassette.

6. The system of 1 wherein the barrels of the first cassette are arranged in an orthogonal grid and the barrels of the second cassette are arranged in a diagonal grid.

7. A tube launched munitions system comprising:

a launcher base having an array of a plurality of initiator stations;

the initiator stations being arranged in an orthogonal grid;

a cassette releasably connected to the launcher base;

the cassette having a plurality of barrels;

the barrels being axially registered with one of the group consisting of diagonally adjacent initiator stations and orthogonally adjacent initiator stations; and wherein a center to center spacing from at least one initiator station to an orthogonally adjacent initiator station is a distance smaller than a center to center spacing from at least one barrel to a diagonally adjacent barrel.

8. The system of claim 7 further comprising a plurality of cassettes having a plurality of barrels, wherein at least one of the cassettes has barrels axially registered with diagonally adjacent initiator stations when that cassette is positioned on the base individually and at least one of the cassettes has barrels axially registered with orthogonally adjacent initiator stations when that cassette is positioned on the base individually.

9. The system of claim 7 wherein the initiator stations are arranged in a rectangular orthogonal grid.

10. The system of claim 7 wherein the initiator stations are arranged in a 2×5 orthogonal grid.

11. The system of claim 8 wherein each of the barrels of the cassette that are axially registered with diagonally adjacent initiator stations have a larger caliber than each of the barrels of the cassette that are axially registered with orthogonally adjacent initiator stations.

12. The system of claim 8 wherein the barrels of the cassette that are axially registered with diagonally adjacent initiator stations are axially registered with a subset of the initiator stations the barrels of the cassette that are axially registered with orthogonally adjacent initiator stations are axially registered with.

13. The system of claim 7 wherein the barrels have an interior bore selected from the group consisting of smooth bores and rifled bores.

14. The system of claim 7 wherein the barrels have a caliber selected from the group consisting of 40 mm and 66 mm.

15. The system of claim 7 wherein the barrels are arranged in configuration selected from the group consisting of a 2×5 orthogonal grid and a diagonal two-tiered grid of 5.

16. A tube launched munitions system comprising:

a launcher base having a plurality of initiator stations;

the initiator stations being arranged in an orthogonal grid;

a first cassette having a plurality of barrels;

the barrels of the first cassette being axially registered with diagonally adjacent initiator stations when the first cassette is positioned on the base individually;

a second cassette having a plurality of barrels;

the barrels of the second cassette being axially registered with orthogonally adjacent initiator stations when the second cassette is positioned on the base individually;

wherein the first cassette and the second cassette are interchangeable and releasably connect one at a time to the launcher base; and wherein a center to center spacing from at least one initiator station to an adjacent initiator station is a distance smaller than a caliber of each of the barrels of the second cassette.

17. The system of claim 16 wherein the initiator stations are arranged in a rectangular orthogonal grid.

18. The system of claim 16 wherein the initiator stations are arranged in a 2×5 orthogonal grid.

19. The system of claim 18 wherein the barrels of the first cassette have a larger caliber than the barrels of the second cassette.

20. The system of claim 16 wherein the barrels have an interior bore selected from the group consisting of smooth bores and rifled bores.

21. The system of claim 16 wherein the barrels of the first cassette have a caliber of 66 mm.

22. The system of claim 16 wherein the barrels of the second cassette have a caliber of 40 mm.

23. The system of claim 16 wherein the barrels of the first cassette are arranged in a diagonal two-tiered grid of 5.

24. The system of claim 16 wherein the barrels of the second cassette are arranged in a 2×5 orthogonal grid.

25. The system of claim 16 wherein the barrels of the second cassette are axially registered with a subset of the initiator stations the barrels of the first cassette are axially registered with.

* * * * *